US009431755B2

(12) United States Patent
Lux et al.

(10) Patent No.: US 9,431,755 B2
(45) Date of Patent: Aug. 30, 2016

(54) CURRENT-CARRYING LEAD AND PLUG CONNECTOR HAVING SUCH A CURRENT-CARRYING LEAD

(71) Applicant: BARTEC GmbH, Bad Mergentheim (DE)

(72) Inventors: Karl-Heinz Lux, Weikersheim (DE); Hans-Martin Lösch, Würzburg (DE)

(73) Assignee: BARTEC GmbH, Bad Mergentheim (DE)

( * ) Notice: Subject to any disclaimer, the term of this patent is extended or adjusted under 35 U.S.C. 154(b) by 200 days.

(21) Appl. No.: 14/367,326

(22) PCT Filed: Dec. 18, 2012

(86) PCT No.: PCT/EP2012/005233

§ 371 (c)(1),
(2) Date: Oct. 20, 2014

(87) PCT Pub. No.: WO2013/091838

PCT Pub. Date: Jun. 27, 2013

(65) Prior Publication Data

US 2015/0044902 A1 Feb. 12, 2015

(30) Foreign Application Priority Data

Dec. 22, 2011 (DE) ..... 10 2011 121 938

(51) Int. Cl.

| | |
|---|---|
| ***H01R 13/58*** | (2006.01) |
| ***H01R 13/52*** | (2006.01) |
| ***H01R 13/595*** | (2006.01) |
| *H01R 24/20* | (2011.01) |

(52) U.S. Cl.

CPC ..... *H01R 13/5205* (2013.01); *H01R 13/5213* (2013.01); *H01R 13/5216* (2013.01); *H01R 13/582* (2013.01); *H01R 13/595* (2013.01); *H01R 24/20* (2013.01)

(58) Field of Classification Search

CPC ..... H01R 13/5205; H01R 13/582; H01R 13/5213; H01R 13/595; H01R 13/5216; H01R 13/5227; H01R 13/523

USPC ..... 439/460–462, 199, 201, 204, 589, 470, 439/449

See application file for complete search history.

(56) References Cited

U.S. PATENT DOCUMENTS

| | | | | |
|---|---|---|---|---|
| 4,717,355 | A | 1/1988 | Mattis | |
| 5,358,429 | A * | 10/1994 | Mina | H01R 13/527 439/469 |
| 6,390,847 | B2 * | 5/2002 | Katwala | 439/491 |
| 7,338,306 | B1 | 3/2008 | Chen | |
| 2007/0066134 | A1 | 3/2007 | Burris et al. | |
| 2010/0112855 | A1 | 5/2010 | Paynter et al. | |

FOREIGN PATENT DOCUMENTS

| | | |
|---|---|---|
| DE | 87 07 994 U1 | 7/1987 |
| FR | 2 908 238 A1 | 5/2008 |
| GB | 2 167 614 A | 5/1986 |

OTHER PUBLICATIONS

FR2908238. Philippe, Electrical Connector with Insulation Gel, 2008. Translation of Description.*

* cited by examiner

*Primary Examiner* — Amy Cohen Johnson
*Assistant Examiner* — Milagros Jeancharles
(74) *Attorney, Agent, or Firm* — Gudrun E. Huckett

(57) ABSTRACT

The invention relates to a current-carrying lead, in particular a connecting lead and a heating tape (5), for a plug connector, which current-carrying lead has at least two strands (49, 50) that are partly surrounded by electrical insulation (47). The current-carrying lead is provided with at least one reservoir (53) for an electrically insulating medium (54). The reservoir (53) is closed by least one plunger (55), by means of which the sealing medium (54) can be forced through at least one outlet nozzle (57) into at least one sealing chamber (58 to 60). The plug connector having a current-carrying lead (3, 5) has a sealing device (36) having a sealing body (66). Said sealing body has an elastically deformable sealing part (71) that can be elastically deformed by means of a wedge-type slider (77). The wedge-type slider (77) has a conical face (82) that interacts with a conical face (76) of the sealing part (71). The wedge-type slider (77), which is preloaded axially by a compression spring element (84), is guided in a holding part (78) axially securing the sealing body (76). The lead (3, 5) is supported in a strain relief device (44) by a multi-point support. Said strain relief device has pressure pieces (91 to 94) respectively located opposite one another in pairs, of which the one pressure piece pair (91, 92) is located at a right angle to the other pressure piece pair (93, 94). The pressure pieces of the one pressure piece pair (93, 94) are forcibly guided by the pressure pieces of the other pressure piece pair (91, 92).

15 Claims, 8 Drawing Sheets

CURRENT-CARRYING LEAD AND PLUG CONNECTOR HAVING SUCH A CURRENT-CARRYING LEAD

BACKGROUND OF THE INVENTION

The invention concerns a current-carrying lead, in particular connecting lead and heating tape, for a plug connector, comprising at least two litz wires that are partially surrounded by an electrical insulation. The invention concerns also a plug connector comprising such a current-carrying lead and comprising at least one sealing device provided for the lead that comprises at least one sealing member that comprises at least one elastically deformable sealing part that, by introducing a force that is acting in the longitudinal direction of the lead, is elastically deformable transversely to this longitudinal direction against the lead, wherein the sealing part is deformable elastically by at least one wedge slider that is provided with a conical surface that interacts with a conical surface of the sealing part. The invention also relates to a plug connector in which the lead is supported by a multi-point support in a strain relief device that has four pressure members which are positioned opposite each other in pairs, respectively.

Current-carrying leads in the form of connecting leads and heating tapes are known which are connected to each other by means of the plug connector. By means of the heating tapes, pipes, containers, channels and the like are maintained at defined temperatures. For example, the heating tapes are attached to conveying lines in order to keep the medium flowing within the conveying lines at a defined temperature so that it is flowable or can stream. Often, at the end of the heating tape moisture will deposit and thereby change the leakage current resistance of the heating tape. In particular in moist or wet conditions of use, the moisture penetrates as a result of capillary action or moisture is generated by a pumping effect which is caused by cooling or heating. Between the litz wires of the heating tape, an initially small, over the course of time greater, moisture collection is produced on which electrical leakage currents can flow. Because of this, there is the risk that the heating tape will suffer from scorch marks between the two litz wires. Progressively, the leakage current resistance can even drop so far that short circuiting may be produced.

Moreover, the contacting action of heating tape and connecting lead must be protected from environmental effects in order to avoid short-circuiting by moisture penetration between the potentials of the litz wires.

For this purpose, glands with matched nut are known through which the electrical lead is projecting. The gland is elastically deformed in radial inward direction so that it contacts seal-tightly the heating tape. This deformation of the gland causes flexing, i.e., a deformation in circumferential direction. This has the result that the sealing effect is reduced because due to the flexing movement passageways inwardly into the plug connector are formed. Accordingly, through the gland moisture from the exterior can penetrate and can cause the afore described problems within the plug connector.

The invention has the object to configure the current-carrying lead of the aforementioned kind and the plug connector of the aforementioned kind in such a way that, while providing a simple configuration and inexpensive assembly, it is ensured that a leakage current generation due to moisture in the plug connector is avoided.

SUMMARY OF THE INVENTION

This object is solved for the current-carrying lead of the aforementioned kind in accordance with the invention in that the electrical insulation comprises at least one reservoir for an electrically insulating medium that is closed off by at least one plunger that forces the sealing medium through at least one outlet nozzle into at least one sealing space. The invention is solved for the plug connector of the aforementioned kind in accordance with the invention in that the wedge slider is guided in a securing part that axially secures the sealing body and in that the wedge slider is pre-tensioned axially by at least one pressure spring element that is actuatable by at least one pressure member. The invention is further solved in connection with the plug connector comprising a strain relief device in that the first oppositely positioned paired pressure members are positioned angularly to the two other oppositely positioned pressure members and in that two oppositely positioned pressure members are forcibly guided by the two other oppositely positioned pressure members.

The current-carrying lead according to the invention is characterized in that a reservoir containing an electrical insulating medium is integrated in its electrical insulation. It is advantageously an electrically insulating gel with which the collection of moisture on the heating tape end or connecting lead end is avoided. The reservoir is closed off by a plunger so that the sealing medium cannot escape to the exterior. When the plunger is pushed into the reservoir, the sealing medium contained therein is forced through the outlet nozzle into the sealing space. Here, the sealing medium distributes within the critical space and prevents thus that moisture can collect therein between the litz wires. The volume of the reservoir is matched to the volume of the sealing space in such a way that the sealing medium completely fills the sealing space in any case. The sealing space is located in front of the insulated end of the heating tape or the connecting lead. The litz wires extend through the sealing space and are, by the way, surrounded by the electrical insulation.

The electrical insulation is advantageously an insulation body that surrounds insulatingly and with mechanical protecting action the litz wires, from which insulation has been stripped across a portion of their length, and that is attached to the heating tape or to the connecting lead.

Advantageously, the plunger is secured against displacement in at least one position on the insulation. The plunger is secured at least in the pushed-in position so that it is ensured that the sealing medium cannot flow out of the sealing space into the reservoir.

It is however also possible that the plunger is positionally secured in its initial position when the reservoir is filled. Then it is ensured that the plunger secures the reservoir outwardly and cannot be lost.

Advantageously, the plunger is displaced only when plugging in the plug connector so that only then the sealing medium is displaced from the reservoir into the sealing space.

The plug connector according to the invention comprises the sealing device which reliably protects the contacting action of heating tape and connecting lead from environmental effects. The sealing device comprises the sealing body which comprises the elastically deformable sealing part. By introducing a force acting in longitudinal direction of the lead, it is elastically deformed transversely to this longitudinal direction so that it is contacting seal-tightly the outer side of the lead. Due to this elastic deformation, no flexing action occurs so that no passageways for moisture and the like can form. The sealing part is elastically deformed by at least one wedge slider. With it, the force that is acting in the longitudinal direction of the lead can be deflected very easily into the force which is transversely oriented thereto in order to apply seal-tightly the sealing part against the electrical lead. The sealing part is provided with a conical surface which interacts with a conical surface of the wedge slider. In order to deform the sealing part reliably by means of the wedge slider, the wedge slider is guided within a securing part. By means of the securing part, the sealing body is axially secured so that the latter remains in its position when its sealing part is elastically deformed. The wedge slider is axially pretensioned by means of the at least one pressure spring element so that the sealing function is ensured across a great temperature range. Since at corresponding temperatures the material property and the dimensions of the parts will change, the pre-tensioned wedge slider ensures that the sealing part is always seal-tightly resting on the electrical lead. The pressure spring element is actuated by the at least one pressure member. The pressure spring element is thus supported on the wedge slider as well as on the pressure member that effects the pretension acting on the wedge slider.

The sealing body is advantageously secured in the connector member of the plug connector against transverse sliding. In this way, by means of the transverse sliding securing action and the securing part, the sealing body is properly positionally secured upon elastic deformation of the sealing part as well as in the mounted position.

The pressure member is advantageously slidably guided within the securing part.

The pressure member is advantageously arranged such that it is actuated upon insertion of a plug component group.

The actuating element is advantageously a component of such a plug component group of the plug connector.

In the plug connector, advantageously a strain relief device for the lead is provided downstream of the sealing device.

In an advantageous embodiment, the securing part comprises an annular wall that is resting against an inner wall of a receiving space of a connector member of the plug connector.

In a preferred embodiment, the wedge member of the wedge slider is arranged between the securing part and the sealing part. In this way, the sealing part is forced securely against the lead to be sealed.

Preferably, the wedge member of the wedge slider has a straight outer side in axial section with which the wedge member is resting against an appropriate inner surface of the securing part. In this way, it is prevented that the securing part is deformed in radial direction inwardly.

The pressure spring element engages advantageously an end face recess of the wedge slider.

The plug connector according to the invention comprises at least one strain relief device by means of which a multi-point support action of the lead is enabled. The strain relief device is arranged such in the plug connector that possibly occurring tension forces are kept away from the contacting action and the downstream sealing device. The multi-point centering action has the result that the electrical lead, which can be a heating tape or a connecting lead, is centered. When downstream of the strain relief device a sealing device for the strain-relieved electrical lead is provided, then an optimal sealing action is ensured as a result of the centering action. The pressure members of the strain relief device are arranged in pairs opposite each other wherein the first oppositely positioned paired pressure members are positioned angularly to the two other oppositely positioned pressure members. Two oppositely positioned pressure members are forcibly guided by the two other oppositely positioned pressure members. In this way, by the movement of two oppositely positioned pressure members, all pressure members are moved in the direction toward or away from the electrical lead. In this way, it is possible to clamp the electrical lead very simply between the pressure members for strain relief or to release the electrical lead again. Due to the forced guiding action, an automatic centering action of the lead is realized so that the lead can be optimally sealed.

An advantageous forced guiding action results when the forcibly guided pressure members engage, by means of cams, guides of the other two oppositely positioned pressure members. With such a form fit action between the pressure members a reliable uniform adjustment of all pressure members is achieved.

In an advantageous embodiment, the guides of the other pressure members are provided at lateral surfaces of these pressure members and extend oppositely slanted relative to each other. In this way, it is ensured in a simple way that the pressure members are moved opposite to each other outwardly or inwardly in the direction toward the lead.

In order for the lead to be arranged reliably between the pressure members, it is advantageous to provide two pressure springs between two oppositely positioned pressure members. They load these two pressure members in such a way that they move away from the lead. By means of the forced guiding action, the two other pressure members are also moved correspondingly. By means of the pressure springs, the pressure members are thus moved apart from each other.

The pressure springs are seated advantageously on link members which link the two oppositely positioned pressure members with each other.

In an advantageous embodiment, the oppositely positioned pressure members are perpendicularly slidable relative to the other two oppositely positioned pressure members.

Further features of the invention result from the further claims, the description, and the drawings.

BRIEF DESCRIPTION OF THE DRAWINGS

The invention will be explained in more detail with the aid of some embodiments illustrated in the drawings. It is shown in:

FIG. 1 in section a plug connector according to the invention with two connector members prior to plugging in;

DESCRIPTION OF PREFERRED EMBODIMENTS

The plug connector serves to electrically connect a connecting lead with a heating lead. The released heat of the heating lead keeps pipes or surfaces at the constant desired temperature and compensates partially differences in the ambient temperature.

Figure 1:
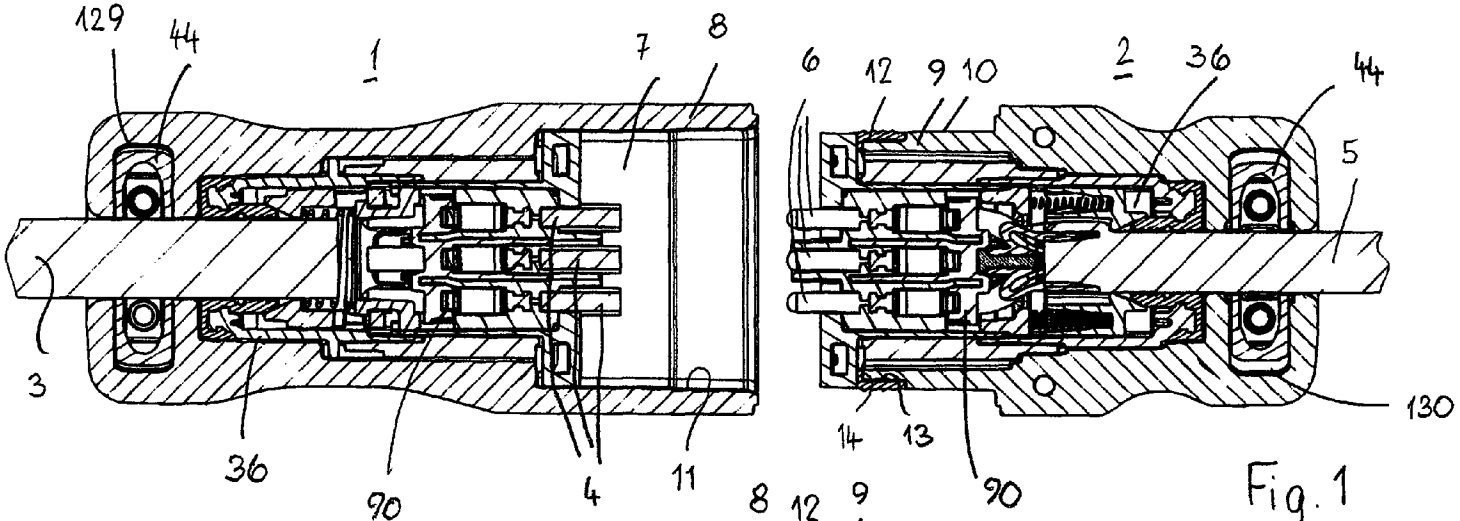
Figure 2:
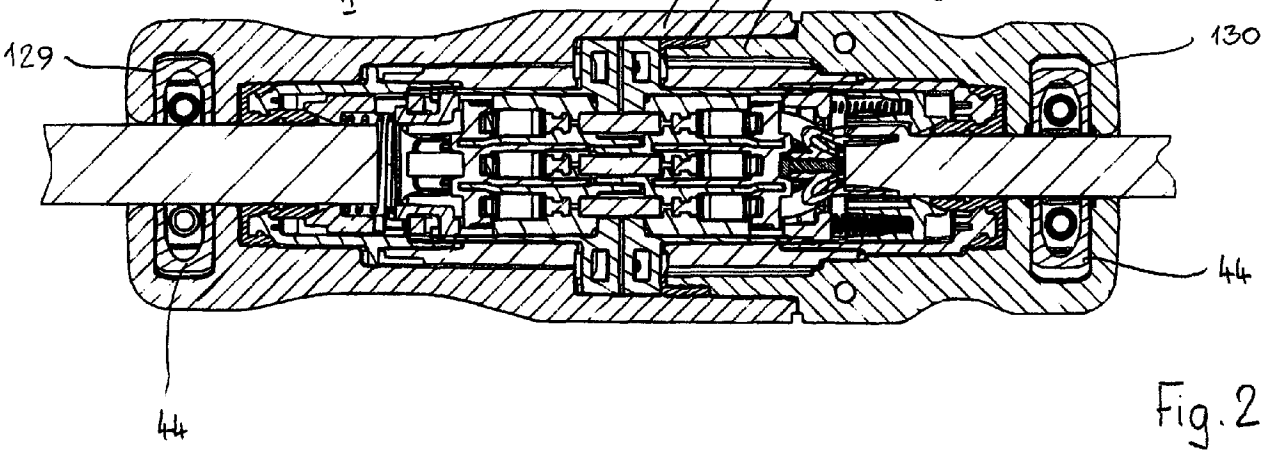
FIG. 2 the plug connector according to FIG. 1 with plugged-in connector members.

The plug connector has two connector members 1, 2 which are shown in FIG. 1 in unplugged position and in FIG. 2 in plugged-in position. The connector member 1 is connected to the connecting lead 3 by means of which current/voltage is supplied to the female connectors 4.

The connector member 2 is provided with the heating tape 5 that, like the connecting lead 3, is extending out of the connector member. The heating tape 5 is electrically connected with male connectors 6 which engage the female connectors 4 when the connector members 1, 2 are plugged in (FIG. 2).

The female connectors 4 of the connector member 1 project partially into a receiving space 7 which is delimited by a part of the housing 8 of the connector member 1. The connector member 2 engages with a head part 9 the receiving space 7. The head part 9 is form-fittingly secured in the receiving space 7 and is resting with its outer wall 10 against the inner wall 11 of the receiving space 7.

The head part 9 is provided on its exterior side with a circumferential seal 12 which is accommodated in an annular groove 13 that is open toward the end face of the head part 9. The seal 12 covers also a part of the end face 14 of the head part 9. In the plugged-in state, the seal 12 is seal-tightly resting against the inner wall 11 of the receiving space 7.

Figures 3, 4, 5:
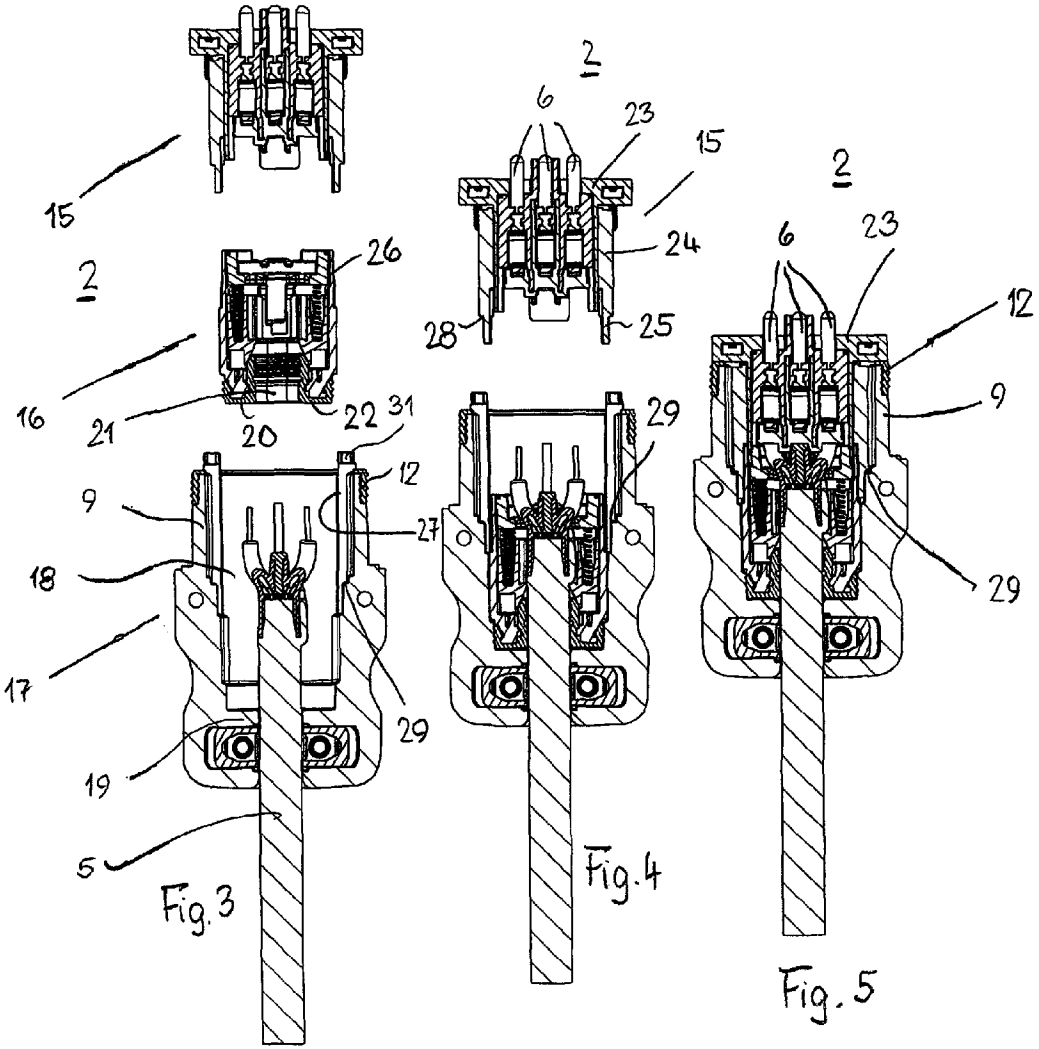
FIGS. 3 to 5 in section, respectively, various mounting steps upon assembly of one of the connector members.

The connector member 2 is comprised of three component groups 15 to 17 (FIG. 3). The component group 17 has a receiving space 18 which is open at the end face and is closed off by a bottom 19. A heating tape 5 projects though it into the receiving space 18. The component group 17 comprises the head part 9 with the described seal 12.

Into the component group 17, the component group 16 is inserted which is arranged with form fit in the receiving space 18. The component group 16 is inserted so far that with its end face 20 it contacts the bottom 19 of the component group 17 (FIG. 4). In the component group 16, there is a sealing device 36 with which the heating tape 5 is sealed in the entry area into the component group 16 in a way to be described in the following (FIGS. 10 to 13). This device is designed such that the heating tape 5 initially loosely projects through the through opening 21 so that it can be connected easily with the male connectors 6.

The component group 16 is provided with a shaped seal 22 with which the heating tape 5 is sealed. Also, with the shaped seal 22 the component group 16 is sealed near the bottom 19 relative to the component group 17.

The component group 16 is completely accommodated within the receiving space 18. In a final mounting step, the component group 15 provided with the male connectors 6 is inserted into the receiving space 18. The component group 15 has a cover 23 with which, in the mounted position (FIG. 5), it is resting with interposition of the seal 12 on the end face of the head part 9 of the component group 17. The cover 23 projects past a housing part 24 that extends with a tapering end 25 between the free end 26 (FIG. 3) of the component group 16 and the inner wall 27 (FIG. 3) of the receiving space 18. At the transition to the free end 25, the housing part 24 is provided with a circumferential outer step 28 with which the component group 15 comes to rest on a step 29 in the inner wall 27 of the receiving space 18.

The head part 9 of the component group 17 is provided at the end face with at least one locking element 31 with which the component group 15 is locked in the mounted position. The cover 23 of the component group 15 is provided with at least one counter locking element (not illustrated) that is interacting with the locking element 31. The male connectors 6 are projecting through the cover 23 of the component group 15.

The component groups 15, 16 each are formed as plug-in component groups which can be mounted by simple plug-in processes in the component group 17.

Figure 6:
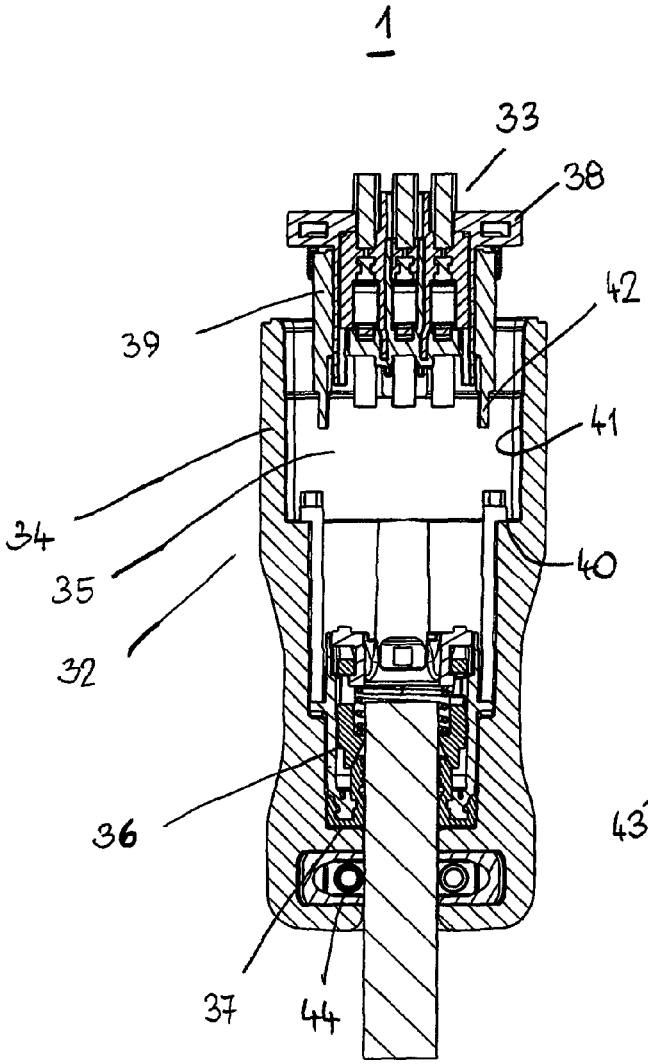
FIGS. 6 and 7 in section, respectively, individual method step upon assembly of the other connector member.
Figure 7:
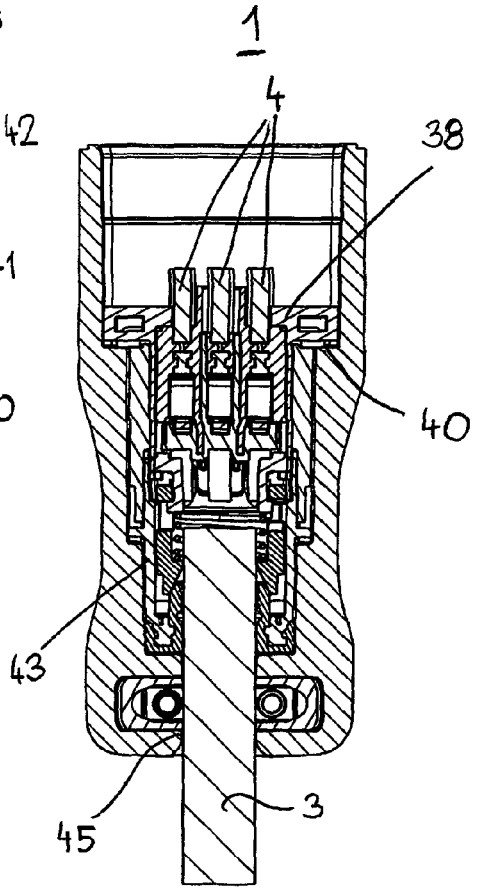

The connector member 1 (FIGS. 6 and 7) comprises the component group 32 into which the component group 33 is inserted. The component group 32 comprises a housing 34 with a receiving space 35 for the component group 33 and a sealing device 36 which will be explained in more detail with the aid of FIGS. 10 to 13. The sealing device 36 is inserted so far into the receiving space 35 that it contacts the bottom 37 of the receiving space 35.

The component group 33 is substantially of the same configuration as the component group 15. The component group 33 comprises a cover 38 that projects past a housing part 39 on all sides and, in the mounted position (FIG. 7), is resting on a circumferential step 40 in the inner wall 41 of the receiving space 35. The housing part 39 is resting against the inner wall 41 of the receiving space 35 in the area between the step 40 and the sealing device 36. The tapering free end 42 of the housing part 39 is positioned on the outer side of a stop sleeve (securing part) 43 of the sealing device 36.

Through an opening 45 in the bottom 37 of the housing 34 of the component group 32, the connecting lead 3 is projecting whose leads are electrically connected with the female connectors 4. By means of the sealing device 36, the connecting lead 3 is reliably sealed within the receiving space 35.

In the bottom part of the housing 34, a strain relief device 44 is accommodated as will be explained in more detail with the aid of FIGS. 14 to 16. The cover 38, as has been explained with the aid of the component group 15, is locked with the housing part 39.

At one end of the heating tape 5 (FIGS. 8 and 9) the insulation is removed. Onto this end 46 without insulation, an insulation element 47 is attached. It comprises a sleeve part 48 which is matched to the circumference of the heating tape 46 without insulation and is seated fixedly on the heating tape 5. The heating tape 5 comprises in an exemplary fashion two litz wires 49, 50 which are connected electrically to the male connectors 6. The parts of the litz wires 49, 50 without insulation are surrounded across the greatest portion of their length by the hose-shaped insulating parts 51, 52 which are advantageously formed monolithically with the sleeve part 48. The insulating parts 51, 52 are seated fixedly on the litz wires 49, 50.

In the area between the insulating parts 51, 52, the insulating element 47 is provided with a reservoir 53 for an electrically insulating sealing medium 54. The sealing medium is advantageously an electrically insulating gel.

The reservoir 53 is closed off by a plunger 55. The reservoir 53 is located in a center part 56 of the insulating element 47. Advantageously, the center part 56 is in the area between the insulating parts 51, 52 and is advantageously monolithically formed therewith. The plunger 55 closes off the reservoir 53 at the free end of the center part 56. At the other end, a nozzle-shaped opening 57 with only minimal cross-section opens into the reservoir 53 and penetrates the bottom of the center part 56.

The center part 56 of the electrical insulation element 47 is spaced from the heating tape 5 so that between them a sealing space 58 is formed which is empty before connecting the heating tape 5 to the male connectors 6. The sealing space 58 is penetrated by the litz wires 49, 50. In their area, the sealing space 58 is provided with conical sealing spaces 59, 60 through which the litz wires 49, 50 are extending.

Figure 9:
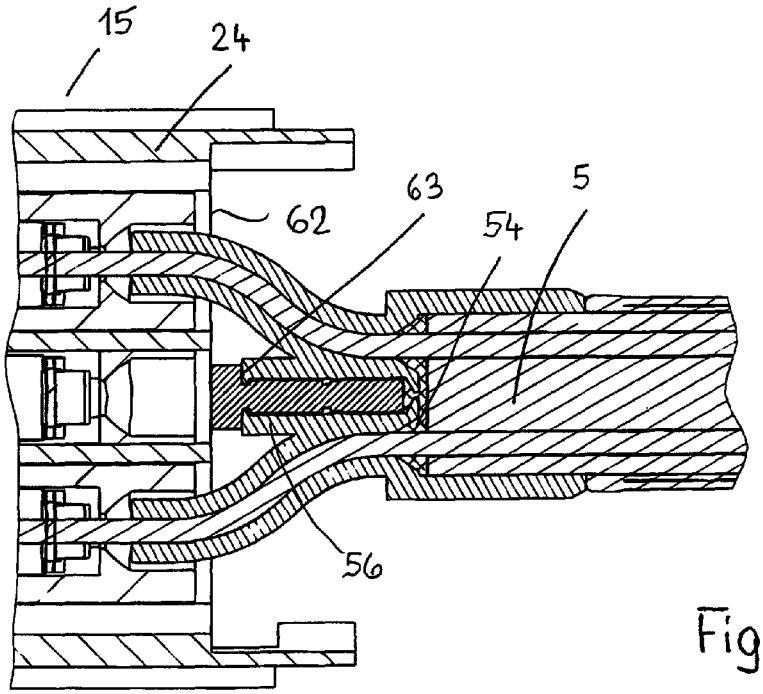
FIG. 9 the heating tape after attachment to the connector member with suppressed plunger.

When the heating tape 5 is connected to the male connectors 6, the plunger 55 with its head 61 will contact the bottom 62 of the housing part 24 of the component group 15. Upon assembly, the plunger 55 is pushed into the reservoir 53 to such an extent that, with the heating tape 5 mounted, it is resting with its head 61 on the end face 63 of the center part 56. The dimensions are such that the head 61 is resting on the bottom 62 of the housing part 24 as well as on the end face 63 of the center part 56 (FIG. 9). The sealing medium 54 which is contained within the reservoir 53 is displaced by the plunger 55 via the opening 57 into the sealing spaces 58 to 60. The quantity of sealing medium 54 as well as the volume of the sealing spaces 58 to 60 are matched to each other such that the sealing spaces are completely filled by the sealing medium 54. This sealing medium prevents that moisture can collect in the area of the sealing spaces 58 to 60. Accordingly, in case of moist or wet conditions of use of the heating tape 5, it is prevented that, as a result of capillary action, moisture can penetrate which could lead to an electrically conducting creeping path between the two litz wires 49, 50 and thus to dangerous leakage currents. The sealing medium 54 prevents thus in the worst case that short-circuiting occurs whereby the heating tape 5 and thus the entire plug connector would be destroyed.

The plunger 55 is resting against the wall of the center part 56 in such a way that no sealing medium 54 can escape past the plunger 55.

Figure 8:
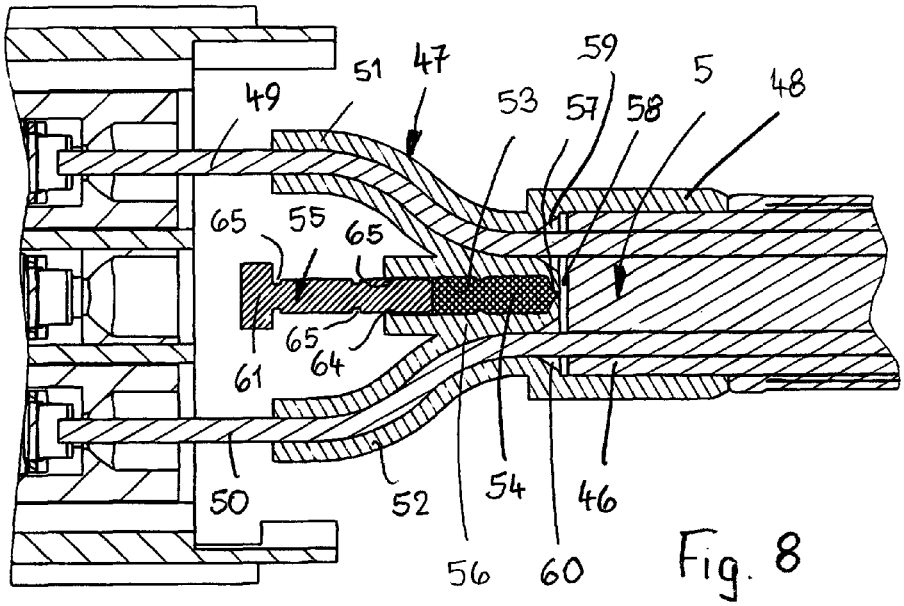
FIG. 8 in an enlarged illustration the connecting area of a heating tape that is to be connected with one of the connector members, before attachment on this connector member, still without actuation of the plunger.

In the initial position according to FIG. 8, the plunger 55 is positionally secured. At the free end of the center part 56 an inwardly projecting circumferential rim 64 is provided that engages an annular groove 65 at the circumference of the plunger 55.

The plunger 55 has at least one further annular groove 65 in the area of the underside of the head 61. Into it, the rim 64 of the center part 56 engages when the litz wires 49, 50 are connected to the male connectors 6.

In the embodiment, the plunger 55 is also provided with a further annular groove 65 so that it can be maintained in an intermediate position.

In the end position according to FIG. 9, the plunger 55 is not only secured by engagement of the rim 64 of the center part 56 but also by contact of the head 61 of the plunger 55 on the bottom 62 of the housing part 24.

This sealing action cannot only be used in case of the heating tape 5 but also for the connecting lead 3.

The sealing device 36 in the connector member 2 has a sealing body 66 (FIG. 10) that forms the shaped body 22 (FIG. 3) which is arranged in the receiving space 18 of the base member 17. In the installed position, the sealing body 66 is resting on the bottom 19 which is provided at the inner side, at a spacing from the inner wall 27 of the receiving space 18, with an annular projection 67 which engages an annular groove 68 of the sealing body 66. Accordingly, the sealing body 66 is positionally secured in radial direction within the receiving space 18. The annular groove 68 is located at the underside of an annular disk 69 of the sealing body 66.

An annular part 70 adjoins the radial outer rim of the annular disk 69 and an annular part 71 adjoins the radial inner rim of the annular disk 69. Both annular parts 70, 71 are formed monolithically with the annular disk 69. The outer annular part 70 is provided at its outer side with a corrugated profile 72. With it, it is resting seal-tightly against the inner wall 27 of the receiving space 18.

The inner annular part 71 which is longer in axial direction of the sealing body 66 is also provided on the inner side with a corresponding corrugation profile 73. It extends from the free end only across a part of the axial height of the annular part 71. Adjoining the annular disk 69, the inner annular part 71 is resting with its inner side against an annular wall 74 which is projecting from the bottom 19 into the receiving space 18 and delimits an insertion opening 75 for the heating tape 5.

The inner annular part 71 of the sealing body 66 has a slanted end face 76 interacting with a wedge slider 77. It is axially slidably supported within a securing part 78.

The securing part 78 has an annular wall 79 which is resting against the inner wall 27 of the receiving space 18. The wedge slider 77 is resting with its exterior side of the wall 80 against the inner side of the wall 79. The wall 80 adjoins the wedge member 81 which is of an annular shape and whose end face wedge surface 82 is interacting with the conical end face wedge surface 76 of the sealing body 66. The wedge member 81 has a smaller outer diameter than the wall 80.

The annular wall 80 of the wedge slider 77 has two depressions 83 in which a pressure spring 84 is positioned, respectively. The pressure springs 84 are supported with one end on the bottom of the depressions 83 and with the other end on a pressure member 85 that is slidably guided within the securing part 78. The pressure member 85 is resting on an actuating element 86 that is guided also on the inner side of the wall 79 of the securing part 78. The actuating element 86 is a component of the component group 15 that is inserted into the component group. During this insertion process, the pressure member 85 is displaced by the actuating element 86.

Figure 10:
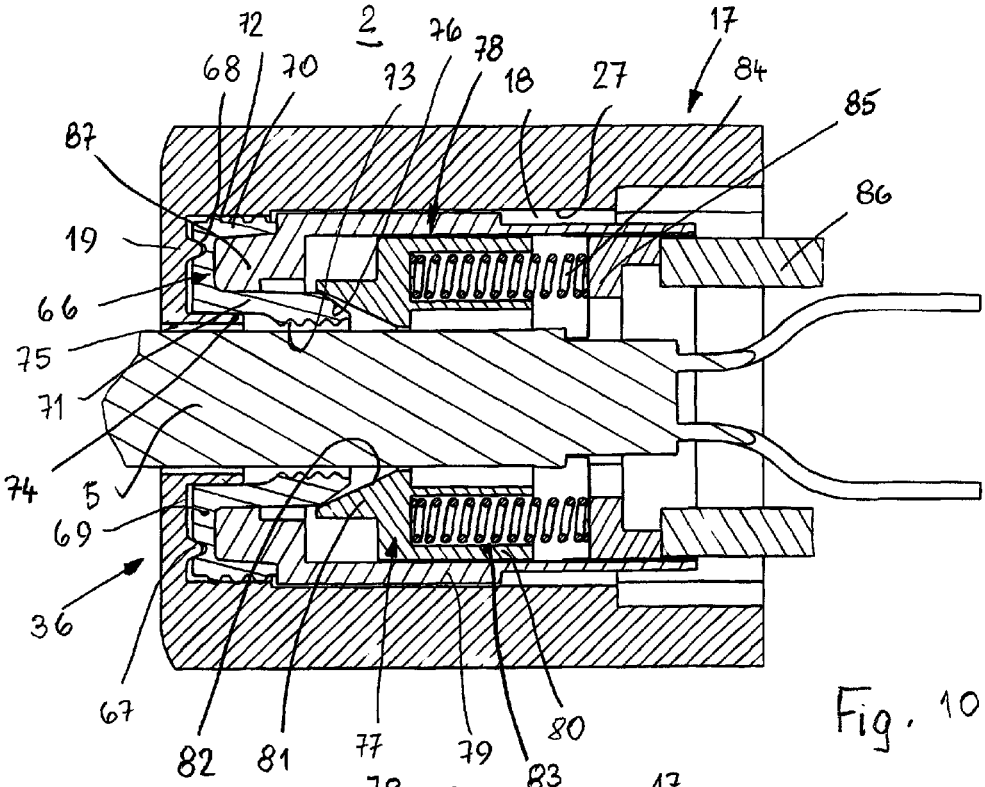
FIG. 10 in section and in enlarged illustration a sealing device for sealing a heating tape or a connecting lead within one of the connector members of the plug connector according to the invention in a first position.
Figure 11:
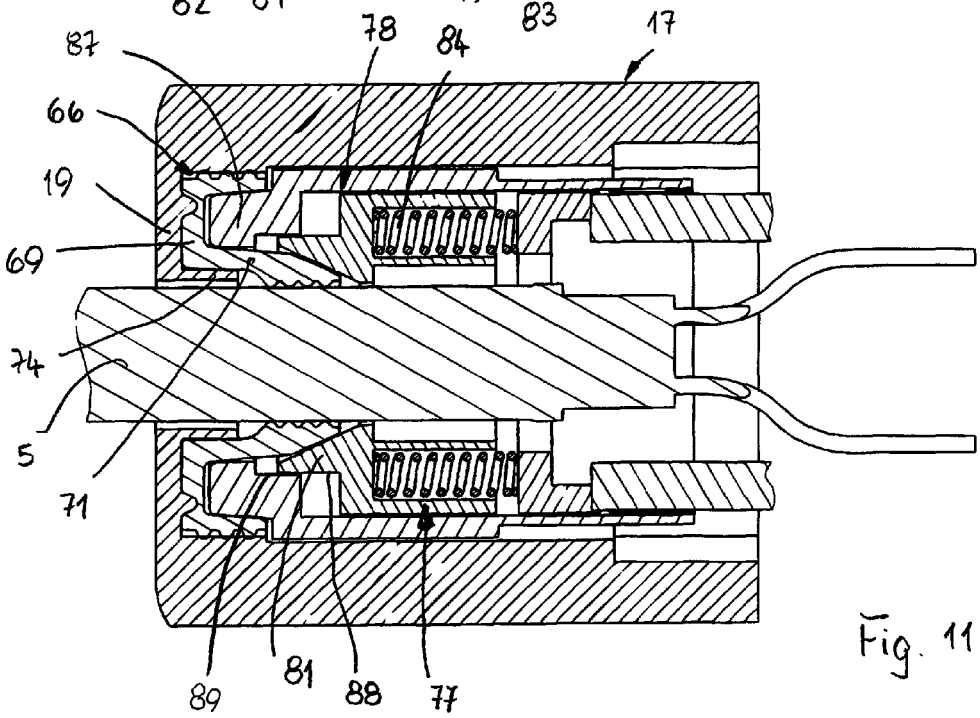
FIG. 11 the sealing device according to FIG. 10 in a second position.

FIG. 10 shows the sealing device 36 in the initial position. The sealing body 66 is positioned with the outer annular part 70 on the inner wall 27 of the receiving space 18 while the inner annular part 71 has a spacing relative to the heating tape 5. The sealing body 66 is seated on the projection 67 wherein the annular disk 69 of the sealing body 66 has a spacing relative to the bottom 19. The wedge slider 77 contacts the conical end face 76 of the annular part 71. When the component group 15 is inserted with the actuating element 86 into the component group 17, the wedge slider 77 is displaced by means of the pressure member 85 and the pressure springs 84. The wedge surface 82 of the wedge slider 77 pushes onto the conical end face 76 of the inner annular part 71 and displaces thereby the sealing body 66 axially to such an extent that it is contacting with its annular disk 69 seal-tightly the bottom 19 of the component group 17 (FIG. 11). The part of the inner annular part 71 of the sealing body 66 which is projecting past the annular wall 74 of the component group 17 is deformed in radial inward direction elastically to such an extent that it contacts seal-tightly with its inner side the heating tape 5.

The pressure springs 84 are pretensioned such that the sealing body 66 ensures the sealing action of the heating tape 5 even after long periods of use. The sealing body 66 and the sealing wedge 77 are matched to each other such that over an extended period of use of the plug connector a sufficiently large retensioning travel is available. In this way, it is ensured that the annular part 71 of the sealing body 66 is seal-tightly resting about the circumference of the heating tape 5.

The wedge slider 77 is properly guided within the securing part 78. The securing part 78 has a terminal area 87 with which it engages between the two annular parts 70, 71 of the sealing body 66. The terminal area 87 is designed such that the two annular parts 70, 71 with their outer sides facing each other are resting areally against the outer sides of the terminal area 87 and the annular disk 69 of the sealing body 66 in the initial position (FIG. 10) is resting areally against the end face of the terminal area 87. The terminal area 87 ensures in this way that upon displacement and upon elastic deformation of the sealing body 66 the two annular parts 70, 71 are each held in or moved into their sealing position. Advantageously, the terminal area 87 tapers conically in the direction of its free end. In the plugged-in position, the annular disk 69 of the sealing body 66 has a minimal spacing from the end face of the terminal area 87 of the securing part 78 (FIG. 11). The terminal area 87 overlaps the annular wall 74 of the component group 17, viewed in radial direction (FIGS. 10 and 11). In this way, it is ensured that in particular the inner annular part 71, when it is elastically deformed, remains clamped between the terminal area 87 and the annular wall 74 so that the inner annular part 71 is deformed reliably in radial inward direction for seal-tight contact on the heating tape 5.

With the sealing body 66 and the wedge slider 77 a targeted elastic deformation is achieved. The spring forces may be minimal. They are only adjusted to be so high that the annular part 71 of the sealing body 66 is resting in radial inward direction seal-tightly on the heating tape 5. The spring force can be relatively minimal because the radial deformation is achieved by the wedge surface 82 of the wedge slider 77. As a result of the radial deformation by means of the described wedge effect, the inner annular part 71 is substantially moved only radially against the heating tape 5 so that at the contact locations between the annular part 71 and the heating tape 5 no flexing effect occurs. Such flexing actions occur in known seals because they deform in circumferential direction whereby leakages occur so that the medium can reach the litz wires of the heating tape 5.

In the initial position of FIG. 10, the heating tape 5 is still freely movable in the component group 17 because the annular part 71 of the sealing body 66 has a spacing relative to the heating tape. It can therefore be simply displaced into the position that is beneficial for assembly. Only upon insertion of the component group 15, the annular part 71 is deformed in the described way by means of the ramp that is formed by the interacting wedge surfaces 76, 82 in radial inward direction until sealing contact on the heating tape 5 occurs. In the installed position, the pressure springs 84 exert a sufficiently high force so that the annular part 71 is resting seal-tightly on the heating tape 5.

The corrugation profiles 72, 73 on the two annular parts 70, 71 are designed in axial section approximately of a semi-circular shape. The two corrugation profiles have thus an O-ring-like contour which ensures a proper sealing action. In the inserted position, this O-ring-like contour is moreover elastically deformed so that a high sealing action is achieved.

Since the sealing body 66 is pretensioned by the pressure springs 84, the plug connector can be used also in a wide temperature range without problems without the sealing action being impaired. Thus, the described plug connector is for example suitable for a temperature range of approximately −60° C. to approximately +180° C. Since in this temperature range the material properties as well as the dimensions of the individual parts of the component group will change, by means of the described elastic deformation of the sealing body 66 in combination with the pretensioned pressure springs 84 it is ensured that a good sealing action is ensured any time.

In the installed position (FIG. 11), the wedge member 81 of the wedge slider 77 extends across the terminal area 87 of the securing part 78. The wedge member 81 has a straight outer side 88 in axial section with which the wedge member 81 is contacting an appropriate inner surface 89 of the terminal area 87 of the securing part 78. As a result of this overlap, it is ensured that the securing part 78 in the area of the terminal area 87 is not deformed in radial inward direction. At the same time, with this overlap it is ensured that the annular part 71 in the elastically deformed area is forced safely against the heating tape 5.

In the embodiment according to FIGS. 10 and 11, the sealing device 36 is provided with two oppositely positioned pressure springs 84.

Figure 12:
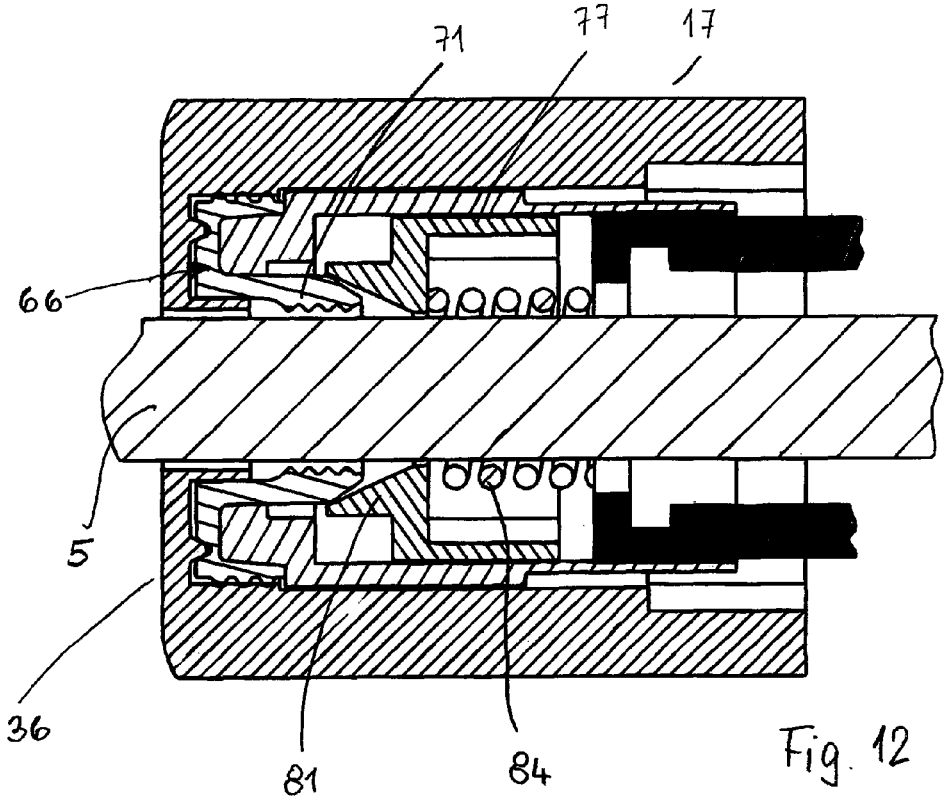
FIGS. 12 and 13 in illustrations corresponding to FIGS. 10 and 11 a second embodiment of the sealing device.
Figure 13:
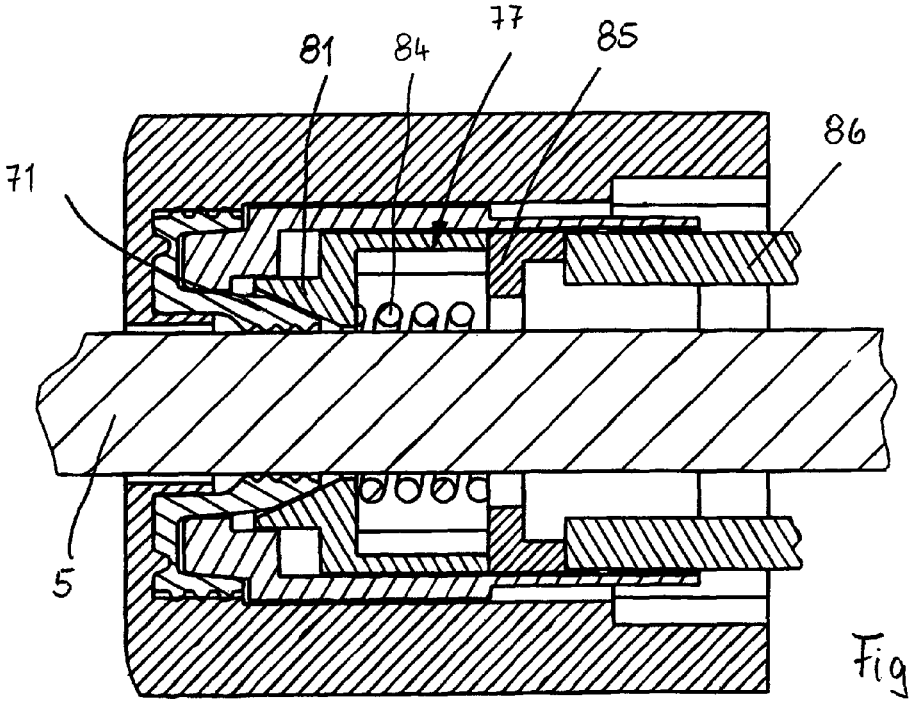

In the embodiment according to FIGS. 12 and 13, only a single pressure spring 84 is used instead which surrounds the heating tape 5 with play. In other respects, this embodiment is of the same configuration as the embodiment according to FIGS. 10 and 11. In the initial position (FIG. 12) the heating tape 5 can be displaced easily in the longitudinal direction because the inner annular part 71 of the sealing body 66 has a spacing relative to the heating tape 5. When the component group 15 (FIGS. 3 to 5) is inserted into the component group 17, then its actuating element 86 pushes on the pressure member 85 and displaces it to such an extent that it is contacting the wedge slider 77. By means of the wedge member 81, the annular part 71 is elastically inwardly deformed in the described way to such an extent that it seal-tightly comes to rest against the heating tape 5.

With the two described embodiments of sealing devices 36, heating tapes 5 with different outer dimensions can be sealed. With the sealing device 36 not only the heating tape 5 is sealed but also the area of the downstream terminals 90 (FIG. 1). Also, the areas of the male connectors 6 or the female connectors 4 are in this way protected against penetration of moisture and the thus resulting leakage currents.

With the aid of FIGS. 10 to 13, the sealing action of the heating tape 5 has been described. As shown in FIGS. 1 and 2, the sealing device 36 is however also provided in the connector member 1 for sealing the connecting lead 3. It can also be sealed simply in the described way wherein the sealing action is reliably ensured across the described great temperature range.

The strain relief device 44 is provided on both connector members 1, 2 for the connecting lead 3 as well as the heating tape 5 (FIGS. 1 and 2) and will be explained in more detail with the aid of FIGS. 14 to 16.

The connecting lead 3 or the heating tape 5 is clamped between four pressure members 91 to 94. In this way, a four-point strain relief action is provided. The pressure members 91 and 92 are approximately of the same configuration and arranged mirror-symmetrical to each other. The oppositely positioned pressure members 93 and 94 are embodied identically but are mirror-symmetrically arranged relative to each other. For this reason, in the following only one of the pressure members 91 and 93 will be explained in more detail.

The pressure member 91 has a block-shaped base member 95 with two lateral surfaces 96, 97 that are parallel to each other. The underside 98 extends substantially straight while the opposite top side 99 is convexly curved across its length. The base member 95 has at both ends narrow sides 100, 101 that are parallel to each other and adjoin at a right angle the lateral surfaces 96, 97.

Figure 14:
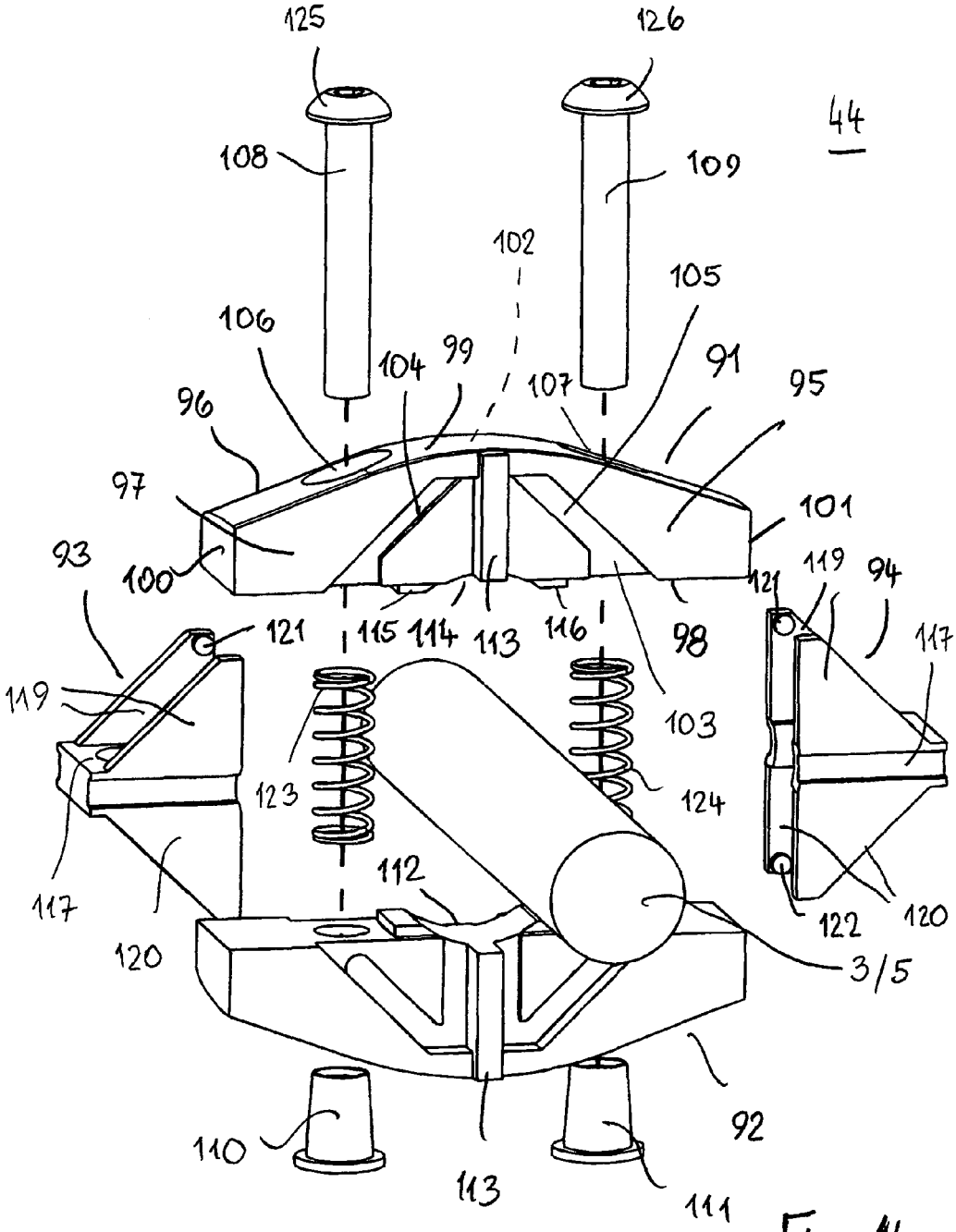
FIG. 14 in enlarged and exploded illustration a strain relief device of the plug connector according to the invention.

The two lateral surfaces 96, 97 are provided with recesses 102, 103 of which in FIG. 14 only one recess 103 can be seen. The recess 102 which is located in the narrow side 96 is embodied identically to the recess 103. These recesses 102, 103 taper from the underside 98 in the direction of the top side 99 of the base member 95. In each one of the recesses, there are two grooves 104, 105 that extend, converging relative to each other, from the underside 98 and extend across the height of the recess 102, 103.

The base member 95 is penetrated by two openings 106, 107 that are parallel to each other as well as perpendicular to the underside 98. Through these openings 106, 107, screws 108, 109 are inserted with which in connection with the threaded bushings 110, 111 the two pressure members 91 and 92 are linked with each other. Since the pressure members 93, 94 are connected with form fit with the pressure members 91, 92, the pressure members 93, 94 are also secured by means of the screws 108, 109 and the threaded bushings 110, 111.

At half the length, on the lateral surfaces 96, 97, a rib 112, 113 is provided, respectively, which extends in the vertical direction from the bottom side 98 to the top side 99 of the base member 95 and separates the two grooves 104, 105 from each other. The ribs 112, 113 project past the lateral surfaces 96, 97.

At half the length, the bottom side 98 of the base member 95 is provided with a recess 114 which is matched to the contour of the connecting lead 3 or of the heating tape 5. On either side of the recess 114, two projections 115, 116 extend past the bottom side 98. The projections 115, 116 extend across the width of the underside 98 and serve as stops with which the pressure members 91, 92 may come to rest on each other. The projections 115, 116 are so high that in contact position the connecting lead 3 or the heating tape 5 positioned therebetween is not deformed in an impermissibly strong way.

The pressure members 93, 94 are designed as sliding wedges that are slidable perpendicular to the pressure members 91, 92. The pressure members 93, 94 comprise a flat clamping piece 117 whose end face clamping surface 118 (FIGS. 15 and 16) is matched to the contour of the connecting lead 3 or the heating tape 5.

From the top side and bottom side of the clamping piece 117, two flat webs 119, 120 are projecting along its longitudinal side that each are of a triangular configuration. The triangle sides that are facing the connecting lead 3 or the heating tape 5 of all webs 119, 120 are positioned in a common plane. Near the top triangle tip the webs 119, 120 are provided with cams 121, 122 on their inner sides that are facing each other. The cams 121, 122 engage the grooves 104, 105 of the pressure members 91, 92.

In the area between the pressure members 91, 92, a pressure spring 123, 124 is seated, respectively, on the screws 108, 109 and is supported with its ends on oppositely positioned bottom sides 98 of the pressure members 91, 92. In the mounted position of the strain relief device 44, the pressure springs 123, 124 are pretensioned.

Figure 15:
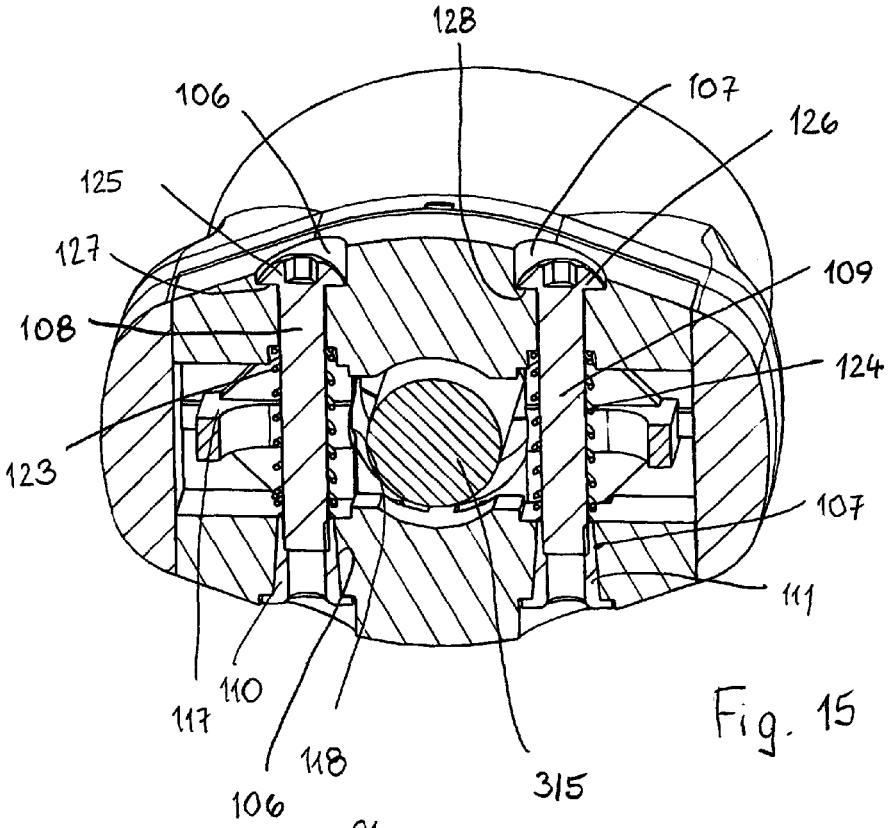
FIG. 15 in an enlarged illustration the strain relief device according to FIG. 14 in a first position.
Figure 16:
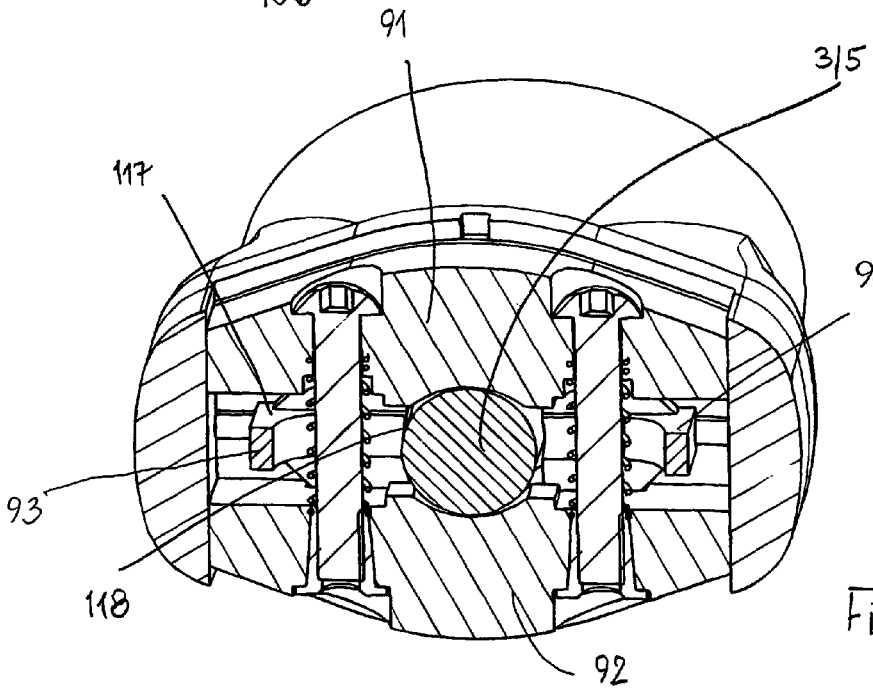
FIG. 16 the strain relief device according to FIG. 14 in a second position.

The screws 108, 109 are positioned recessed with their screw head 125, 126 in the openings 106, 107 of the pressure member 91 (FIGS. 15 and 16). For contacting the screw head 125, 126, the openings 106, 107 are provided with a step 127, 128, respectively, on which the screw head 125, 126 is resting.

The threaded bushings 110, 111 are positioned recessed in the openings 106, 107 of the base member 95. These openings are matched to the shape of the threaded bushings 110, 111 such that the latter are resting areally across their length against the inner wall of the openings 106, 107.

The screws 108, 109 are screwed in initially only so far into the threaded bushings 110, 111 that the pressure members 91 to 94 have a spacing relative to the connecting lead 3 or to the heating tape 5 (FIG. 15). When the connecting lead or the heating tape assume their final position, the screws 108, 109 are screwed farther into the threaded bushings 110, 111. In doing so, the pressure members 91, 92 approach each other. At the same, the sliding wedges 93, 94, as a result of the engagement of their cams 121, 122 in the grooves 104, 105, are also moved toward each other. The grooves 104, 105 in the pressure members 91, 92 extend at 45° relative to the ribs 112, 113 so that the sliding wedges 93, 94 are displaced uniformly together with the pressure members 91, 92 against the connecting lead 3 or the heating tape 5. The screws 108, 109 are screwed in to such an extent that the pressure members 91 to 94 fixedly clamp the connecting lead 3 or the heating tape 5 sufficiently (FIG. 16). By means of the four pressure members a 4-point strain relief action is realized wherein they are resting at locations of the connecting lead 3 or of the heating tape 5 that are rectangularly positioned relative to each other.

The pressure springs 123, 124 ensure that the pressure members 91 to 94 are automatically returned upon unscrewing the screws 108, 109. The pressure members 93, 94 are moved away from each other as a result of their mandatory guiding action in the pressure members 91, 92.

The triangular webs 119, 120 of the pressure members 93, 94 are positioned in the recesses 102, 103 of the pressure members 91, 92. The webs 119, 120 are so narrow that they do not project, or only project a little, from the recesses 102, 103. The strain relief device 44 therefore occupies only little space.

As shown in FIGS. 1 and 2, the strain relief devices 44 in the connector members 1, 2 are arranged near the inlet opening of the connecting lead 3 or of the heating tape 5 in appropriate receiving spaces 129, 130.

With the 4-point clamping action, the connecting line 3 or the heating tape 5 is always centrally clamped. Accordingly, the connecting lead 3 or the heating tape 5 are also guided centrally through the inlet opening of the connector members 1, 2 into the interior. Since a 4-point clamping action is realized, the connecting lead 3 or the heating tape 5 are not changed, or changed only a little, with regard to their circumferential shape contour. The four points of attack of the pressure forces lead to a reliable and high strain relief action so that even at higher tension forces there is no risk that the connecting lead 3 or the heating tape 5 is pulled out of the connector members 1, 2.

The strain relief device 44 ensures also that the heating tape and the connecting lead are centered exactly relative to the sealing device and therefore also a proper sealing action is ensured.

What is claimed is:

1. A current-carrying lead for a plug connector, the current-carrying lead comprising:

at least two litz wires surrounded by an insulation jacket and each comprising a free end from which the insulation jacket has been removed;

a separate electrical insulation element partially surrounding the free ends of the at least two litz wires across a portion of a length of the free ends, respectively, wherein between the electrical insulation element and an end of the insulation jacket at the free ends at least one sealing space is formed;

wherein the electrical insulation element comprises hose-shaped insulation parts that partially surround the free ends of the at least two litz wires;

wherein the electrical insulation element comprises at least one reservoir and at least one plunger, wherein the at least one reservoir comprises a first end and a second end opposite the first end, wherein the first end comprises at least one outlet opening that opens into the at least one sealing space and wherein the at least one plunger closes off the second end;

wherein the at least one reservoir contains an electrically insulating sealing medium, and wherein the at least one plunger is configured to force the sealing medium through the at least one outlet into the at least one sealing space adjacent to the at least one reservoir.

2. The lead according to claim 1, wherein the at least one plunger in at least one position is secured against displacement on the electrical insulation element.

3. The lead according to claim 1, wherein the at least one plunger is displaced when plugging in the plug connector so that the at least one plunger forces the sealing medium into the at least one sealing space.

4. A plug connector comprising:

at least one current-carrying lead comprising at least two litz wires and further comprising an electrical insulation partially surrounding the at least two litz wires, wherein the electrical insulation comprises at least one reservoir that is closed off by at least one plunger and contains an electrically insulating sealing medium, wherein the at least one reservoir comprises at least one outlet nozzle and wherein the at least one plunger is configured to force the sealing medium through the at least one outlet nozzle into at least one sealing space adjacent to the at least one reservoir;

at least one sealing device for the current-carrying lead, wherein the at least one sealing device comprises at least one sealing body comprising at least one elastically deformable sealing part comprising a first conical surface;

at least one wedge slider provided with a second conical surface interacting with the first conical surface of the at least one elastically deformable sealing part;

a securing part that axially secures the sealing body;

wherein, by applying a force that is acting in a longitudinal direction of the current-carrying lead on the at least one wedge slider, the at least one elastically deformable sealing part is elastically deformed transversely to the longitudinal direction against the current-carrying lead;

wherein the at least one wedge slider is guided in the securing part; and wherein the at least one wedge slider is pre-tensioned axially in the longitudinal direction by at least one pressure spring element actuatable by at least one pressure member.

5. The plug connector according to claim 4, wherein the at least one pressure member is slidably guided within the securing part.

6. The plug connector according to claim 4, further comprising a plug component group comprising an actuating element that is operatively acting on the at least one pressure member.

7. The plug connector according to claim 4, further comprising a connector member comprising a receiving space with an inner wall, wherein the securing part comprises an annular wall that is resting against the inner wall of the receiving space of the connector member.

8. The plug connector according to claim 4, wherein the at least one wedge slider comprises a wedge member that is positioned between the securing part and the at least one elastically deformable sealing part.

9. The plug connector according to claim 8, wherein the wedge member has a straight outer side, viewed in an axial section view, and the straight outer side of the wedge member is resting against an inner surface of the securing part.

10. The plug connector according to claim 4, wherein the at least one wedge slide has an end face depression and the at least one pressure spring element is positioned in the end face depression.

11. A plug connector comprising:

a current-carrying lead;

a strain relief device providing a multi-point support for the current-carrying lead;

wherein the strain relief device comprises a first pair of pressure members oppositely positioned relative to each other and further comprises a second pair of pressure members oppositely positioned relative to each other;

wherein the first pair of pressure members are positioned angularly relative to the second pair of pressure members;

wherein the first pair of pressure members and the second pair of pressure members are linked to each other such that the second pair of pressure members are forcibly guided by the first pair of pressure members;

two pressure springs arranged between the first pair of pressure members.

12. The plug connector according to claim 11, wherein the second pair of pressure members comprises cams and the first pair of pressure members comprises guides, wherein the cams engage the guides.

13. The plug connector according to claim 12, wherein the guides are provided at lateral surfaces of the first pair of pressure members and extend oppositely slanted relative to each other.

14. The plug connector according to claim 11, further comprising link members that link the first pair of pressure members with each other, wherein the pressure springs are seated on the link members.

15. The plug connector according to claim 11, wherein the first pair of pressure members are slidable perpendicularly relative to the second pair of pressure members.

* * * * *